United States Patent [19]

Greenlee et al.

[11] Patent Number: 4,702,313

[45] Date of Patent: Oct. 27, 1987

[54] SLIP AND SLIP ASSEMBLY FOR WELL TOOLS

[75] Inventors: Donald R. Greenlee, Cedar Hill; Lee M. Lustig, Garland, both of Tex.

[73] Assignee: Dresser Industries, Inc., Dallas, Tex.

[21] Appl. No.: 738,214

[22] Filed: May 28, 1985

[51] Int. Cl.[4] ..... E21B 23/00

[52] U.S. Cl. ..... 166/216; 285/144

[58] Field of Search ..... 166/215, 216, 217, 125; 175/422 WS; 285/144, 145, 146, 147, 148

[56] References Cited

U.S. PATENT DOCUMENTS

| | | | |
|---|---|---|---|
| 2,207,469 | 7/1940 | Roye | 285/144 |
| 2,825,410 | 3/1958 | Brown | 166/216 |
| 3,066,738 | 12/1962 | Myers | 166/140 |
| 3,643,737 | 2/1972 | Current et al. | 166/216 |
| 3,749,167 | 7/1973 | Young | 166/217 |
| 4,189,001 | 2/1980 | Greenlee | 166/216 |
| 4,296,806 | 10/1981 | Taylor et al. | 166/120 |
| 4,336,841 | 6/1982 | Garner, Jr. | 166/216 |
| 4,359,090 | 11/1982 | Luke | 166/217 |

*Primary Examiner*—Stephen J. Novosad
*Assistant Examiner*—William P. Neuder

[57] ABSTRACT

An improved slip and slip assembly for use with well tools such as anchors. The slip assemblies include a plurality of slips having ends formed by segments of circles, having a concave outer surface including teeth arranged to hold in both the upwardly and outwardly directions, and concave expander surfaces arranged to mate with the tapered surfaces of expanders on a well tool to move the slips into engagement with the well bore wall. The slips are held in the assembled relationship by a plurality of garter springs that extend through arcuate holes that extend through the sidewalls of the slips.

8 Claims, 9 Drawing Figures

SLIP AND SLIP ASSEMBLY FOR WELL TOOLS

BACKGROUND OF THE INVENTION

This invention relates generally to an improved retrievable anchor assembly for use in well bores and the like. More particularly, but not by way of limitation, this invention relates to an improved slip and improved slip assembly for a well tool such as a retrievable anchor assembly.

Tubing anchor/catchers are, among other things,utilized in wells which have to be pumped order to produce the oil therefrom. The well bores are usually lined by casing and may have production tubing therein through which sucker rods from a reciprocating pump pass. The oil pump itself is generally suspended from the lower end of the sucker rods deep in the well.

In some well, the depths from which oil will be produced is substantial and therefore, a substantial amount of tension is exerted on the sucker rods during pumping. In fact, the upward stroke of the pump jack places tension in the rod and compression in the tubing and lowering of the rod into the tubing for the next stroke causes a force reversal, that is, a compressive force to be exerted on the rod and a tension force on the tubing. It has been calculated that in an unanchored tubing string being pumped at the rate of 15 strokes per minute, the destructive tubing movement occurs 21,600 times a day on each upstroke. Such buckling of the tubing during the pump stroke causes substantial friction drag and thereby increases the surface power requirements. Also, the reversal of forces occurs 21,600 times each day causing the couplings of the tubing to rub against the casing with resulting coupling wear.

From the foregoing, it will be appreciated that a reversal of forces with their attendant increased friction, wear, and increased power requirements occurs approximately one million times each month. The result of such force reversal is the mechanical erosion of metal from the rods, from the tubing inside diameter and from the exterior of the couplings. Production losses and increased costs occur from leaks in the tubing, higher power requirements, and from more down time necessitated by the replacement of the broken rods and leaking tubing. The use of an effective tubing anchor eliminates many of these problems.

The devices which lock the anchor in the casing are known as slips in the industry. Slips or grippling slips, as they are sometimes called, come in many shapes and various locking configurations. Essentially all slips have exterior teeth and a tapered inner surface that reacts with a tapered expander surface to force the slip teeth into holding engagement with the casing.

Retrievable anchor assemblies of the general type involved in this invention have been constructed and sold by Brown/Hughes under the designation Brown Type M-2, Arrow Oil Tools, Inc. under the designation Arrow Type R Tubing Anchor Catcher, sold by Baker Service Tools under the designations Models B-2 and B-3, as well as by the Guiberson Division of Dresser Industries, Inc., the assignee of this application, under the designation Type TM Tubing Anchor-Catcher.

Each of the foregoing described tools has provided to be reasonably reliable for their intended purpose. However, it is believed that the aforementioned tools were designed at a time when the oil industry was prosperous and accordingly, the tools are comparatively heavy, expensive and in some cases complex beyond that necessary to perform the tubing anchor function properly.

It is an object of this invention to provide an improved slip and slip assembly for retrievable anchors that provides all of the advantages of the prior art devices while at the same time providing an efficient and securely holding anchor utilizing a slip assembly that is effective, easily assembled in the anchor, easily maintained and that can be produced less expensively than comparable slip assemblies.

SUMMARY OF THE INVENTION

This invention then provides an improved grippling slip member comprising an elongated body having: a convex top surface; a concave lower surface with end portions of the lower surface forming frusto-conical segments tapering toward the top surface; end surfaces formed by segments of circles; spaced lug portions projecting outwardly from a pair of side surfaces; and a plurality of holes extending along arcuate paths therethrough intersecting the side surfaces.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
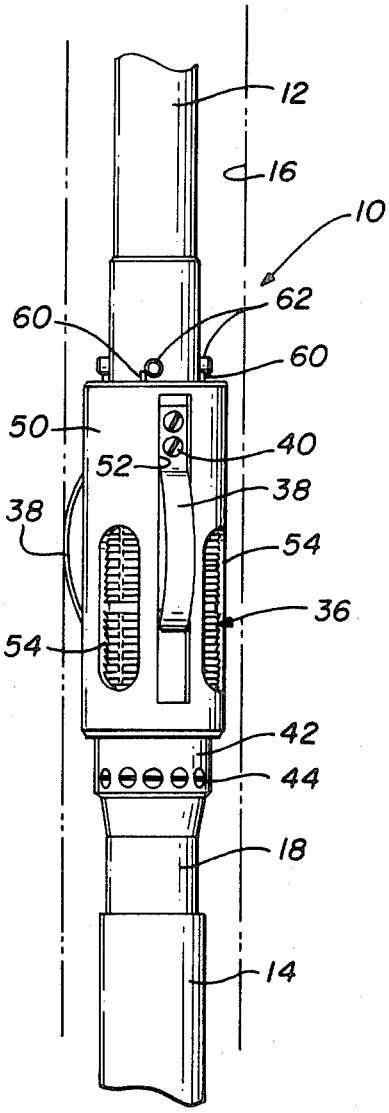
FIG. 1 is an elevation view of an anchor constructed in accordance with the invention that is located in a well bore.

Referring to the drawing and the FIG. 1 in particular, shown therein and generally designated by the reference character 10 is a retrievable anchor assembly that is constructed in accordance with the invention. The retrievable anchor assembly 10 is illustrated as being connected to a section of well tubing 12 at its upper end and to a well tubing 14 or other well apparatus (not shown) at its lower end. The tubing 12 and 14 and the anchor assembly 10 are located in a well bore 16.

Figure 2:
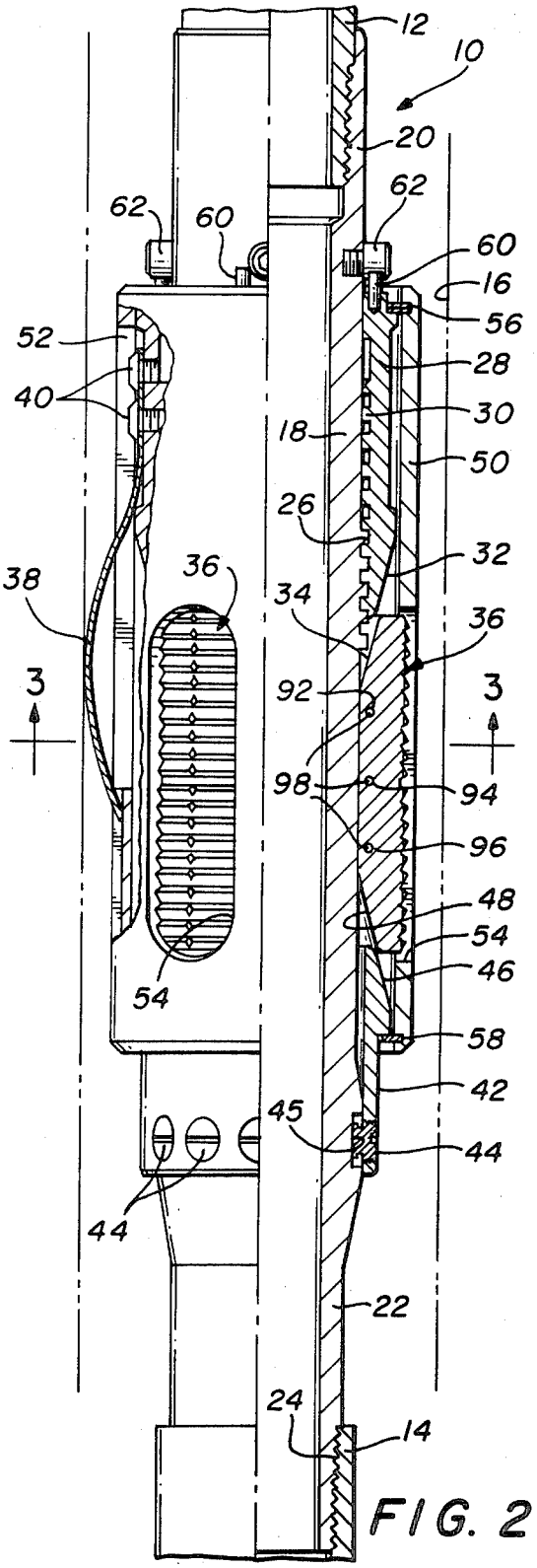
FIG. 2 is an enlarged half sectional view of the retrievable anchor of FIG. 1 shown greatly enlarged.

As may be more clearly seen in FIG. 2, the anchor assembly 10 includes a unitary mandrel 18 that extends entirely therethrough. The mandrel 18 at its upper end 20 is threadedly attached to the lower end of the tubing 12. At lower end 22 of the mandrel 18 there is provided a male thread 24 which threads into the upper end of the tubing 14.

The mandrel 18 has an exterior thread 26 located between the upper and lower ends 20 and 22 respectively. The thread 26 is provided to connect the mandrel 18 to an annular upper expander member 28. The expander member 28 is provided with an interior thread 30 that mates with the thread 26 on the mandrel 18. In addition to the thread 30, the upper expander member 28 is provided with a tapered lower end portion 32 that is arranged to engage a mating tapered surface 34 on the upper end of slips 36, as will be described.

Figure 3:
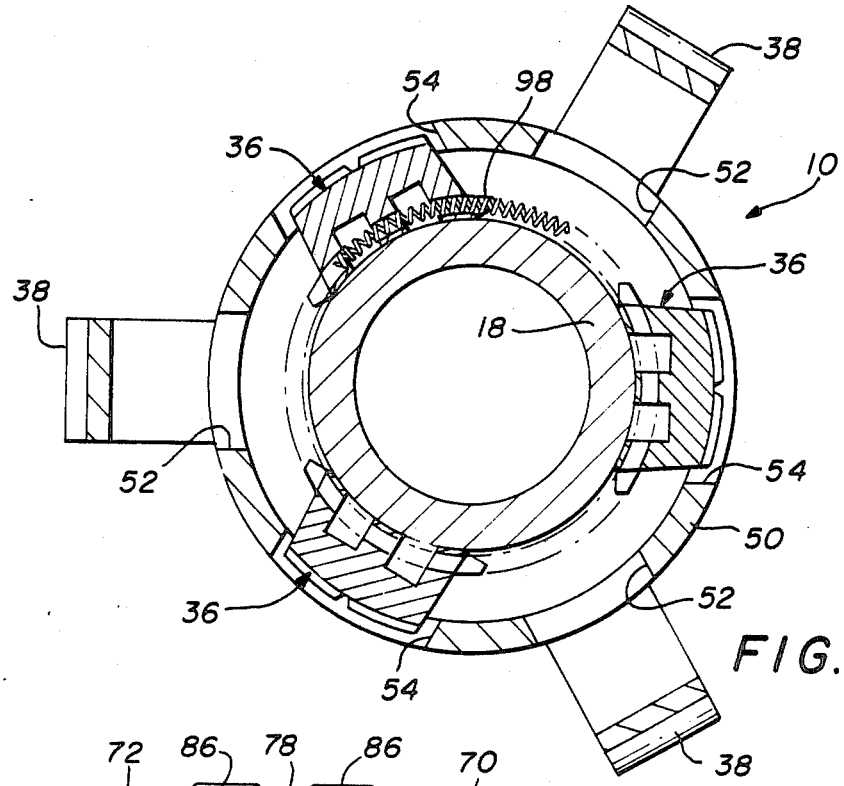
FIG. 3 is a transverse cross sectional view taken generally along the line 3—3 of FIG. 2.
Figure 4:
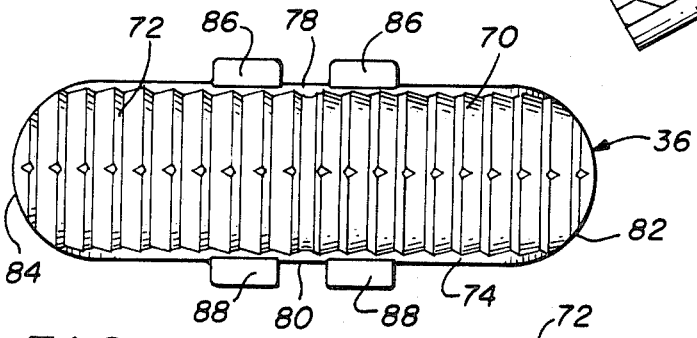
FIG. 4 is a top plan view of a gripping slip utilized in the anchor of FIG. 1 and that is also constructed in accordance with the invention.
Figure 5:
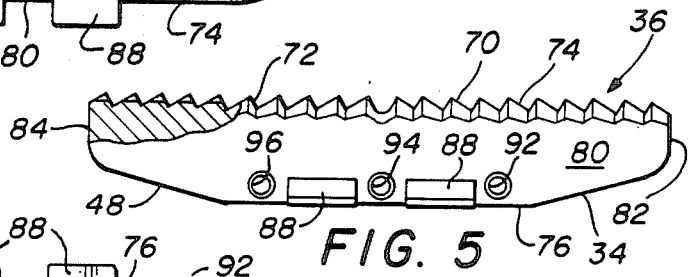
FIG. 5 is a side elevation view of the slip of FIG. 4.
Figure 6:
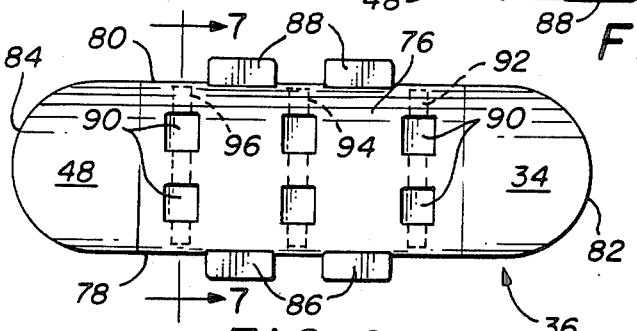
FIG. 6 is a transverse cross sectional view taken along the line 6—6 of FIG. 5.
Figure 7:
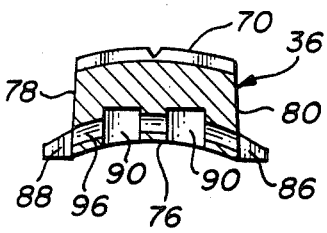
FIG. 7 is a bottom plan view of the slip of FIG. 4.

The upper expander member 28 also carries drag springs 38 that are connected thereto by a plurality of threaded fasteners 40. Only one of the drag springs 38 is illustrated in FIG. 2. (All three springs 38 can be seen in the cross-sectional view of FIG. 3.) The drag springs 38 are provided to center the anchor assembly 10 in the well bore 16, as well as providing a frictional force on the well bore wall 16 to permit operation of the anchor assembly 10, as will be explained hereinafter.

An annular lower expander member 42 is attached to the exterior of the mandrel 18 by a plurality of shear pins 44 which extend into an annular groove 45 in the mandrel 18. The lower expander member 42 includes a tapered upper end portion 46 that is arranged to mate with a tapered lower surface portion 48 on the slips 36.

An annular slip cage 50 encircles a portion of the mandrel 18 and the upper and lower expander members 28 and 42, respectively. The slip cage 50 is provided with a plurality of circumferentially spaced slots 52 through which the drag springs 38 project. The cage 50 is also provided with a plurality of circumferentially spaced openings 54 that are sized to loosely receive each of the slips 36. The circumferential spaced relationship of the slots 52 and of the openings 54 an be clearly seen in the cross-sectional view of FIG. 3. The cage 50 is retained on the anchor assembly 10 by locking rings 56 and 58 that are located at the upper and lower ends thereof, respectively.

Stop pins 60 prevent relative rotation between the mandrel 18 and the upper expander member 28 when the tubing 12 and mandrel 18 are rotated in the right hand direction, that is, in the clockwise direction as viewed from the top of the tubing 12. The stop pins 60 are located in the upper end of the upper expander member 28.

The mandrel 18 is provided with a plurality of stops 62 that engage the stop pins 60 so that the tubing 12, mandrel 18, and expander 20 are together rotated when right hand rotation is imposed on the tubing 12. Counterclockwise or left-hand rotation between the mandrel 18 and the upper expander member 28 is possible since the pitch of the threads 26 and 30 is such that the stop members 62 rise above the upper end of the stop pins 60, and thus do not come into engagement therewith.

The slips 36 are illustrated in more detail in FIGS. 4-7. As shown therein, each of the slips 36 includes an upper convex toothed surface 70. A portion of the teeth on the surface 70 are oriented to hold the anchor assembly 10 against upward movement and the remaining portion are oriented in a downward direction to hold the anchor assembly 10 against downward movement. The upwardly oriented teeth are designated by the reference character 72 and the downwardly oriented teeth are designated by the reference character 74.

Each of the slips 36 is also provided with a concave lower or inner surface 76. The previously mentioned tapered surfaces 34 and 48 are also concave and, of course, extend at an angle relative to the concave inner surface 76.

Sides 78 and 80 extend substantially parallel to each other and terminate at each end in ends 82 and 84 that are formed by segments of circles. The importance of forming the ends 82 and 84 of the slips as segments of a circle, and in this case as essentially half circles, is to permit the openings 54 in the slip cage 50 to be formed by the same milling cutter that forms the remainder of the slot. Thus, such design eliminates several previously required machining operations to form the openings 54 in the cage 50.

Protruding outwardly from each of the sides 78 an 80 of the slips 36 are a pair of spaced dogs 86 and 88, respectively. The dogs are arranged, as can be seen most clearly in FIG. 3, so that they project beyond the outer dimension of the openings 54 so that the slips 36 cannot move outwardly through the openings 54.

Referring again to FIG. 6 (the bottom view of the slip 36), it can be seen that there are a plurality of spaced recesses 90 formed therein. Arcuate holes 92, 94 and 96 extend through each of the slips 36 extending through the sides 78 and 80 thereof. The arcutate configuration of the holes can be seen more clearly in the cross-sectional view of FIG. 7.

Figure 8:
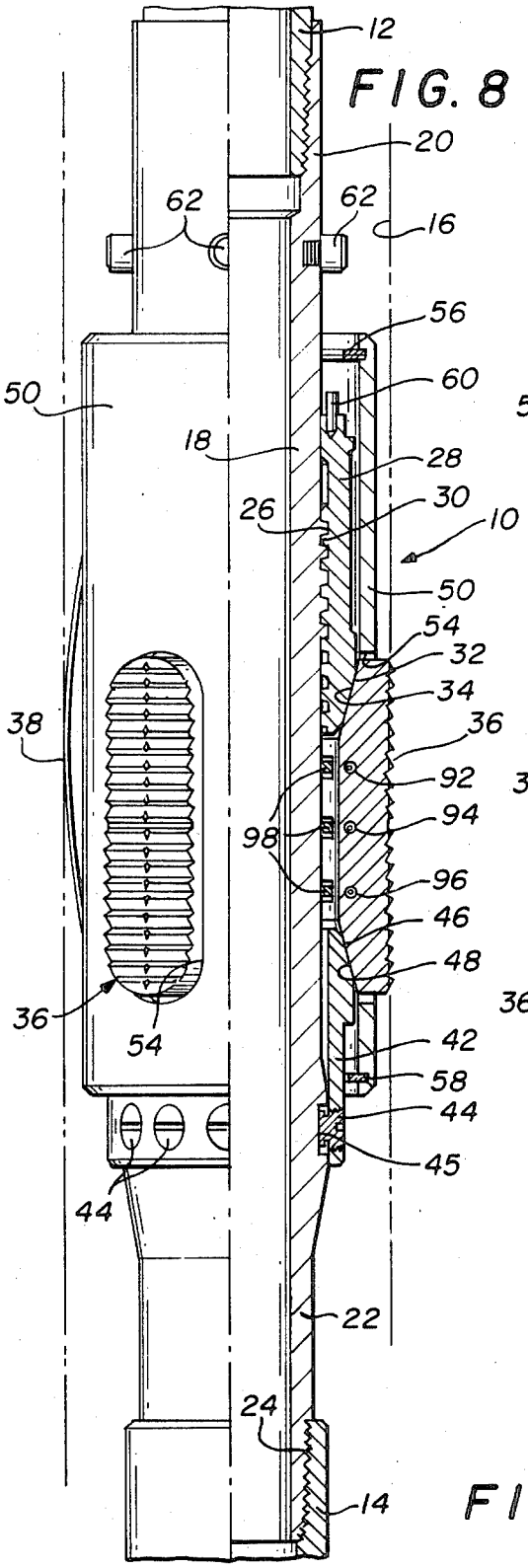
FIG. 8 is a half section view similar to FIG. 2, but showing the anchor in the set position.

The purpose of the holes 90, 92 and 96 can be appreciated from viewing FIG. 8. As shown therein, a garter spring, that is, a continuous tension spring 98, extends through each of the holes 90, 92 ad 96 in each of the slips 36. The tension spring 98 is of less diameter than the exterior of the mandrel 18 so that the slips 36 are continually biased inwardly toward engagement with the mandrel 18. As a matter of fact, replacement slips can be pre-assembled with the garter springs, and when the cage 50 is removed from the anchor 10 to replace the slips 36, the assembly of slips 36 and garter springs 98 can be slipped over the mandrel 18 into position thereon. The cage 50 is then returned to its proper position with the slips 36 located in the openings 54, thus providing for the quick and relatively easy replacement of the slips 36 on the anchor 10.

OPERATION OF THE PREFERRED EMBODIMENT

FIGS. 1, 2, 8 and 9 are useful in discussing the operation of the anchor 10. As shown in FIG. 1, the anchor 10 is lowered into the well bore 16 on a tubing 12. The lower end of the mandrel 18 is connected to either additional tubing 14 or to a piece of well apparatus such as, in the case of this type anchor, a reciprocating downhole pump (not shown).

Upon reaching the desired location in the well bore 16, the tubing 12 is rotated counterclockwise, or in a left-hand direction. When this occurs, the drag springs 38, which are in engagement with the wall of the well bore 1, prevent rotation of the upper expander member 28. Since the upper expander member 28 cannot rotate, the thread 26 begins to drive the upper expander member 28 downwardly bringing the tapered surface 32 thereon into engagement with the tapered surfaces 34 on the upper end of the slips 36. At this time, the cage 50, the slips 36 and the upper expander member 28 move downwardly moving the tapered surface 48 on the lower end of the slips 36 into engagement with the tapered surface 46 on the lower expander member 42.

Continued rotation of the tubing 12 and the mandrel 18 causes the upper expander member 28 to continue its downward movement until the slips 36 are forced outwardly into holding engagement with the wall of the well bore 16 as illustrated in FIG. 8. At this point, the garter springs 98 in the slips 36 have been expanded as the inner surface 76 of the slips 36 move away from the mandrel 18. With the slips 36 in this position, the teeth 72 and 74 thereon are in tight holding engagement with the wall of the well bore 16 and due to their orientation, resist movement of the anchor 10 in either an upwardly or downwardly direction. It can be seen that any upward force imposed on the tubing 12 from above will simply tend to drive the lower expander member 42 into the slips 36 and to move the slips 36 into engagement with the upper expander member 28. Also, forces exerted downwardly tend to force the upper expander member 28 into the slips 36 and to move the slips 36 into the lower expander 42. Such action forces the slips 36 into tighter holding engagement with the wall of the well bore 16.

To release the anchor 10, the tubing 12 is rotated in a clockwise rotation, that is in right-hand rotation, and the thread 26 on the mandrel 18 is rotated thereby relative to the thread 30 on the upper expander, causing the upper expander member 28 to move upwardly and away from the slips 36. When the upper expander member 28 engage the lock ring 56, the cage 50 is moved upwardly, dislodging the slips 36 from the lower expander member 42, permitting the slips 36, uder the influence of the springs 98, to collapse inwardly to the retracted position illustrated in FIG. 2.

In the event that it is not possible to release th slips 36 in the manner described, a feature has been built in which permits retrieval of the anchor 10. This feature involves the shear screws 44 which have their innermost ends located in the annular recess 45 formed in the exterior of the mandrel 18. As illustrated in FIG. 8, the shear pins 44 are intact with the slips 36 in the set position.

Figure 9:
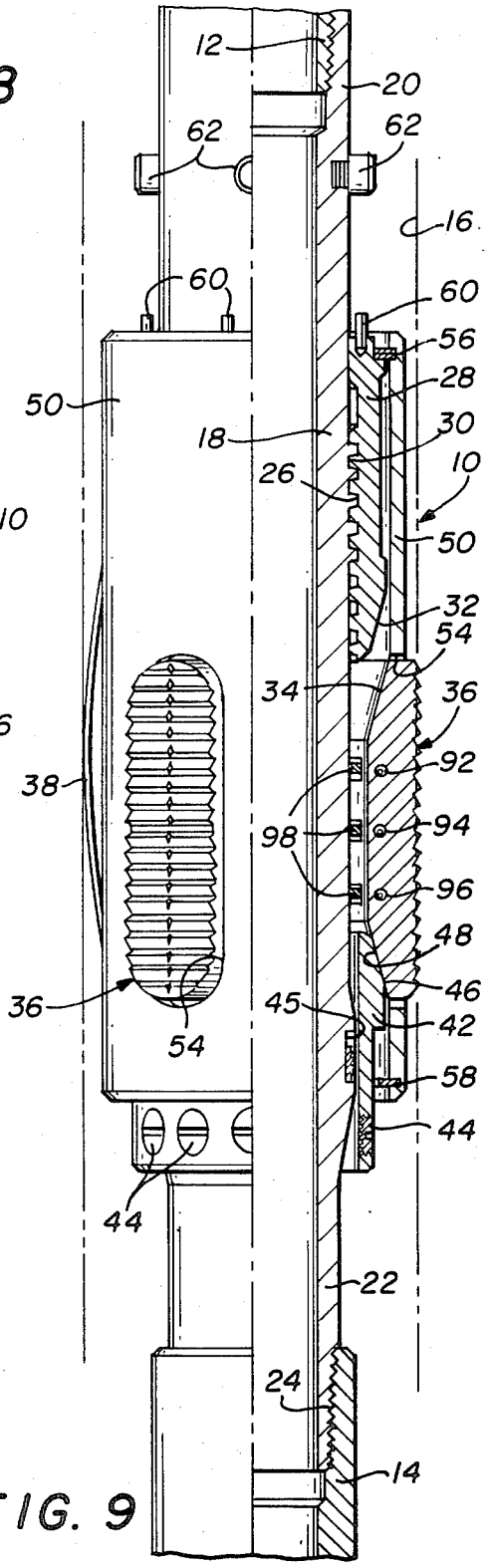
FIG. 9 is a view similar to FIG. 8, but illustrating the position of the various components of the anchor when the shear mechanism has been parted.

As mentioned, if the normal retraction operation does not release the slips 36, a tension force exerted on the tubing string 12 moves the mandrel 18 upwardly to the position illustrated in FIG. 9, dislodging the upper expander member 28 from the slips 36. Continued upward pull causes the shear pins 44 to sever since the lower expander member 42 is securely engaged with the slips 36 which are in holding engagement with the wall of the well bore 16. The lower expander member 42, after shearing the pins 44, cannot be inadvertently lost since the lower lock ring 58 carried by the slip cage 50 engages the lower expander member 42 and brings it to the surface along with the remainder of the anchor 10.

From the foregoing, it will be appreciated that the anchor 10 is extremely simple in construction in that the mandrel 18 is formed from a unitary piece, threaded at the top to accept directly the threaded tubing 12 and at the bottom to be screwed into the tubing 14 or into a well pump, and having a thread thereon for operation of the upper expander member 28. The mandrel, being a unitary member, is extremely strong and relatively easy to manufacture at low cost. The cage 50 has been simplified by the attachment of the drag springs 38 to the upper expander 28 and by the provision of the circular ends to the slips 36 and of the openings 54 extending through the cage 50. The cage 50 is essentially a tubular member. As can be seen, the lower expander member 42 is of relatively simple construction and attached to the mandrel 45 by shear screws 44. Thus, the anchor 10 is durable, easy to manufacture, and relatively low in cost because of the cost saving manufacturing techniques utilized in its manufacture.

It should be pointed out that the slips 36 are relatively simple design and by utilizing the arcutate holes extending therethrough, provides for the preassembly of the slips 36 with the garter springs 98. While this may seem to be a very simple feature, so far as is known, previous slips constructed for such anchors were individually assembled with a multiplicity of springs, each of which is connected individually to each side of each slip. Thus, the assembly of the slips and springs onto the mandrel was a tedious, time-consuming and very difficult process.

Having described but a single embodiment of the invention, it will be understood that many changes and modifications can be made thereto without departing from the spirit or scope of the annexed claims.

What is claimed is:

1. An improved gripping slip member comprising an elongated body having:

a convex top surface;

a concave lower surface with concave end portions of said lower surface forming surfaces tapering toward said top surface; semicircular end surfaces;

spaced lug portions projecting outwardly from a pair of side surfaces; and, a plurality of holes extending along arcuate paths therethrough intersecting said side surfaces.

2. The slip member of claim 1 wherein said top surface has a plurality of grooves extending between said side surfaces in generally parallel relationship forming gripping teeth thereon.

3. The slip member of claim 2 wherein said grooves are angularly disposed with respect to each other whereby one portion of said teeth are arranged to grip in one direction and another portion of said teeth are arranced to grip in a generally opposite direction.

4. A gripping slip assembly comprising:

a plurality of slip members, each including an elongated body having:

a convex top surface;

a concave lower surface with concave end portions of said lower surface forming surfaces tapering toward said top surface;

semicircular end surfaces;

spaced lug portions projecting outwardly from a pair of side surfaces;

a plurality of holes extending along arcuate paths therethrough intersecting said side surfaces; and, an annular resilient member extending through one of said holes in each said slip member resiliently connecting said slip members whereby said slip assembly can be placed on a well tool with said slip member resiliently retained thereon in circumferential spaced relationship.

5. The slip assembly of claim 4 wherein each of said annular resilient members comprises an annular tension spring.

6. An improved gripping slip apparatus comprising:

an elongated mandrel having upper and lower tapered expander members moveable relatively together and apart;

an annular slip cage encircling said mandrel and having a plurality of circumferentially spaced openings therein;

a plurality of slip members located in said openings, each said slip member including an elongated body having a convex top surface, a concave lower surface with concave end portions of said lower surface forming surfaces tapering toward said top surface for engaging said expander members to move said slip member radially in said openings, semicircular end surfaces, spaced lug portions projecting outwardly from a pair of side surfaces, and a plurality of holes extending along arcuate paths therethrough intersecting said side surfaces; and, an annular spring extending through each said slip member and encircling said mandrel to resiliently bias said slip members toward said mandrel.

7. The slip apparatus of claim 6 wherein the openings in said cage are elongated and have semicircular ends to receive said slip members.

8. An improved gripping slip member comprising an elongated body having:

a convex top surface;

a concave lower surface with concave end portions of said lower surface forming surfaces tapering toward said top surface;

end surfaces formed by segments of circles;

a plurality of grooves extending between said side surfaces in generally parallel relationship forming angularly disposed teeth, one portion of said teeth arranged to grip in one direction and another portion of said teeth arranged to grip in a generally opposite direction;

spaced lug portions projecting outwardly from a pair of said side surfaces; and, a plurality of holes extending along arcuate paths therethrough intersecting said side surfaces.

* * * * *